US006029907A

United States Patent [19]

McKenzie

[11] Patent Number: 6,029,907

[45] **Date of Patent: *Feb. 29, 2000**

[54] ADJUSTABLE SPRINKLER NOZZLE

[75] Inventor: Jeff R. McKenzie, Riverside, Calif.

[73] Assignee: The Toro Company, Minneapolis, Minn.

[ * ] Notice: This patent is subject to a terminal disclaimer.

[21] Appl. No.: 09/034,197

[22] Filed: Mar. 3, 1998

Related U.S. Application Data

[63] Continuation of application No. 08/798,809, Feb. 12, 1997, Pat. No. 5,722,592, which is a continuation of application No. 08/665,701, Jun. 18, 1996, abandoned, which is a continuation of application No. 08/173,174, Dec. 23, 1993, Pat. No. 5,526,982.

[51] Int. Cl.[7] ..... B05B 1/16; B05B 3/04

[52] U.S. Cl. ..... 239/240; 239/74; 239/247; 239/443; 239/562; 239/581.1; 239/DIG. 1

[58] Field of Search ..... 239/240, 246, 239/247, 206, 263, DIG. 1, DIG. 12, 602, 443, 587.1, 588, 562, 581.1, 74, 563

[56] References Cited

U.S. PATENT DOCUMENTS 755,995 3/1904 Brown .
2,295,880 9/1942 Valois et al. .
3,193,203 7/1965 Crow .
3,362,641 1/1968 Barnes .
3,428,256 2/1969 Painter .
4,867,378 9/1989 Kah, Jr. .
5,526,982 6/1996 McKenzie ..... 239/240
5,722,593 3/1998 McKenzie ..... 239/240

*Primary Examiner*—Lisa Ann Douglas
*Attorney, Agent, or Firm*—James W. Miller

[57] ABSTRACT

An improved sprinkler nozzle comprises a nozzle body having a nozzle received in a recessed seat provided in a peripheral wall of the nozzle body. The nozzle is formed with a plurality of nozzle ports formed by the radially outer ends of a plurality of vertically flexible nozzle tubes. The flow volume of the water stream being thrown by the sprinkler nozzle is adjusted by selectively operating a flow volume adjustment member carried on the nozzle body to selectively open or close various of the nozzle tubes in various possible combinations. The flow volume of the nozzle will comprise the combined or aggregate flow volumes of the water sub-streams being thrown by those nozzle tubes that are left open. The trajectory of the water stream being thrown by the sprinkler nozzle is adjusted by selectively operating a trajectory adjustment member carried on the nozzle body to bend the flexible nozzle tubes about their vertically fixed, radial inner ends to raise and lower the radial outer ends of the nozzle tubes.

20 Claims, 5 Drawing Sheets

ADJUSTABLE SPRINKLER NOZZLE

This application is a continuation of application Ser. No. 08/798,809, filed Feb. 12, 1997, now U.S. Pat. No. 5,722, 593, which is a continuation of application Ser. No. 08/665, 701, filed Jun. 18, 1996, abandoned, which is a continuation of application Ser. No. 08/173,174, filed Dec. 23, 1993, now U.S. Pat. No. 5,526,982.

TECHNICAL FIELD

This invention relates to an adjustable sprinkler nozzle for use in an irrigation sprinkler for throwing a water stream to one side of the sprinkler. More particularly, this invention relates to a sprinkler nozzle in which the trajectory of the water stream, or the flow volume of the water stream, or both, can be quickly and easily adjusted.

BACKGROUND OF THE INVENTION

Irrigation sprinklers are known for watering circular patterns using essentially a single rotary water stream that is rotated in a circle around a vertical rotational axis. This water stream is thrown by a sprinkler nozzle mounted in the peripheral sidewall of the nozzle body. The sprinkler nozzle is upwardly angled relative to the horizontal so that the water stream being thrown by the nozzle is projected at some given trajectory relative to the horizontal to water a circular pattern having a particular radius. A full circular pattern is watered by such a sprinkler when the sprinkler is rotated unidirectionally. However, the drive means for such a sprinkler can reverse the rotation of the nozzle body, if so desired, to water pie-shaped arc segments that are less than a full circle.

Rotary sprinklers of the type just described have long been manufactured and sold by The Toro Company, the assignee of this invention. For example, the Toro Super 600, Super 606 and Super 700 sprinklers are of this type. In addition, U.S. Pat. No. 3,724,757, which is owned by The Toro Company, illustrates and describes a sprinkler of this type.

In sprinklers using a side mounted nozzle to throw a single primary water stream for watering the desired area, it is relatively difficult to change the flow volume of the stream being thrown by the nozzle. This is most often done by physically removing one nozzle and replacing it with a nozzle having either a larger or smaller water flow area therein to change the flow volume or gallonage capacity of the nozzle. It is difficult to remove the nozzle because the nozzle is recessed inside the nozzle body and cannot be gripped sufficiently to pull it out against the force of the press fit. Thus, the user often needs a tool, such as a screwdriver, which is inserted into the spray apertures of the nozzle to pry the nozzle out of the nozzle seat.

The disadvantages in this approach to adjusting the flow volume of the sprinkler are apparent. The user needs to have available a supply of replacement nozzles of different gallonage capacities to have one corresponding to the capacity that may be needed at the time, and has to have such nozzles with him or her at the time the adjustment is desirably made. Moreover, if the sprinkler is operating at the time one wishes to change the nozzle size, the user first has to shut the sprinkler off which may require going to a remote location to turn off the water supply to the sprinkler. Once the nozzle change is made, another trip back to the water supply is required to turn the water supply back on. In addition, the old nozzle first has to be removed which often damages or destroys the old nozzle preventing its reuse. The need to have a set of differently sized nozzles, and the need to engage in nozzle removal and replacement just to change the gallonage being thrown by the nozzle, increases the cost of such sprinklers and the difficulty of changing the flow volume of the sprinkler.

Undoubtedly, some sprinklers are installed or left in place with nozzles throwing too much or too little water. The user is simply deterred from properly adjusting the flow volume because he or she does not have the right nozzle on hand, or does not wish to remove the nozzle that is already installed, or does not wish to interrupt the water flow to an operating sprinkler.

Most sprinklers of this type also have what is known as a radius adjustment screw for changing the trajectory of the water stream being thrown by the nozzle to adjust the throw radius of the sprinkler. This screw, which is accessible from the top wall of the nozzle body, has a lower end which is screwed down in front of the nozzle to deflect downwardly the stream exiting from the nozzle to adjust the radius of throw. The amount of the deflection depends on the degree to which the lower end of the screw protrudes into the water stream. This screw engages against the top of the front face of the nozzle to help keep the nozzle in place in the seat.

This method of radius adjustment has various problems. Using a screw to protrude into the water stream causes the water stream to laterally spread or split apart in other unpredictable and undesirable ways. This can cause unpredictable and undesirable changes in the precipitation rate provided by the sprinkler. In addition, as the screw protrudes more and more into the water stream, situations will arise where the radius of throw may actually begin to increase again. Thus, it is difficult to get the sprinkler to water a very short radius, i.e. relatively close to the sprinkler itself, using a conventional radius adjustment screw.

SUMMARY OF THE INVENTION

One aspect of this invention is to provide a sprinkler nozzle for throwing at least one water stream having an adjustable flow volume. Such a sprinkler nozzle comprises a nozzle body having means for throwing a plurality of discrete water sub-streams directed together in generally the same direction relative to the nozzle body such that the water sub-streams are grouped together to collectively form the water stream. Flow adjustment means is provided for selectively changing the number of water sub-streams thrown from the nozzle body, thereby to adjust the flow volume of the water stream.

Another aspect of this invention is to provide a simple sprinkler nozzle for throwing a water stream. Such a nozzle comprises a nozzle body and nozzle means carried on the nozzle body for discharging water from the nozzle body. The nozzle means comprises a plurality of vertically flexible nozzle tubes which are grouped together in an array on one side of the nozzle body to provide a water stream projected generally in the same direction which water stream is made of the combination of individual sub-streams issuing from the nozzle tubes.

Yet another aspect of this invention is to provide a sprinkler nozzle of the type noted above which may have its trajectory more easily adjusted. Such a nozzle further includes selectively operable means carried on the nozzle body for vertically bending at least some of the flexible nozzle tubes up and down to raise or lower the trajectory of the water sub-streams exiting from the bent nozzle tubes.

A final aspect of this invention is to provide a sprinkler nozzle having both flow volume and trajectory adjustment means combined in the same nozzle.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
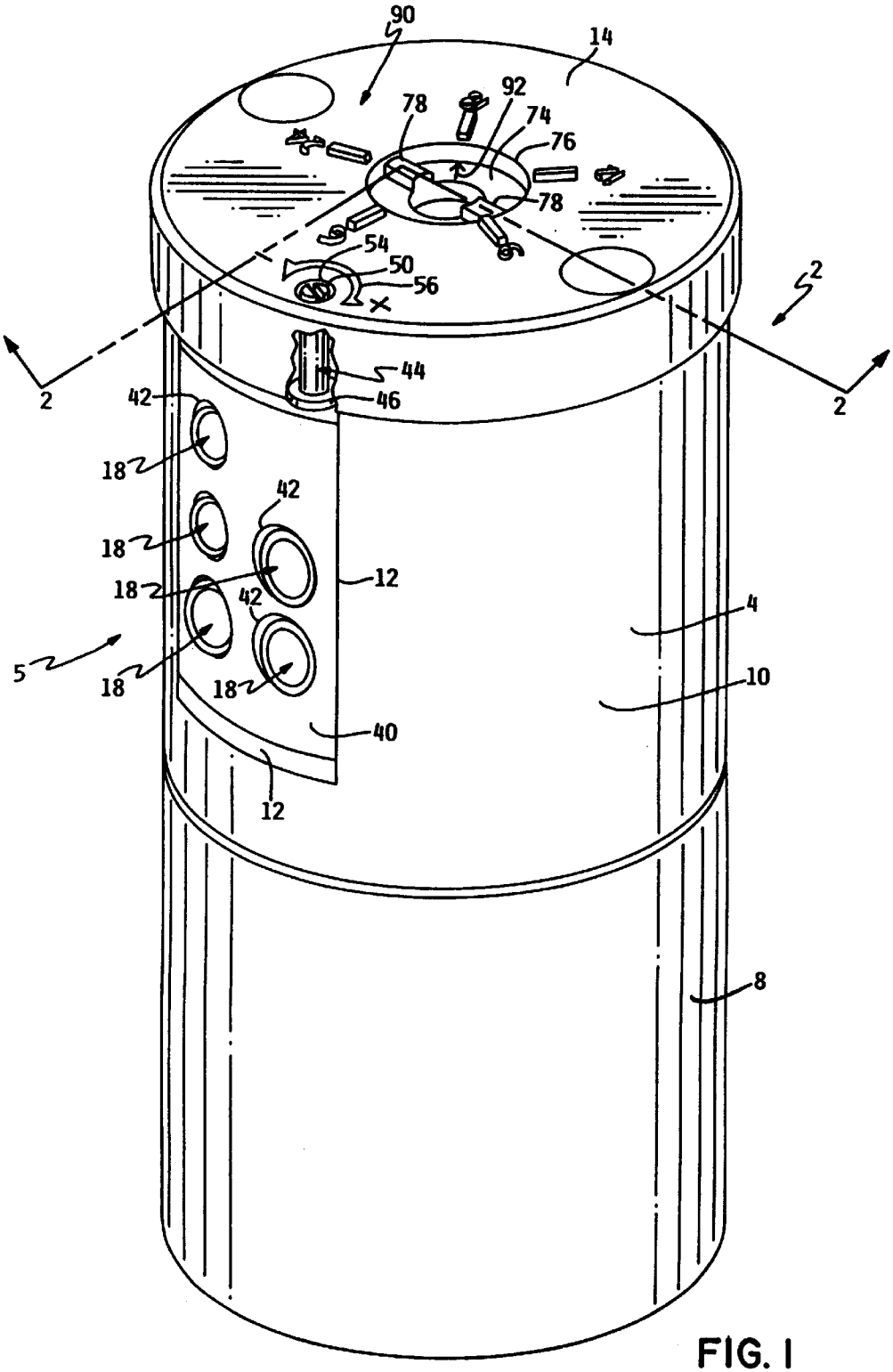
FIG. 1 is a perspective view of a sprinkler nozzle according to this invention, with a portion of FIG. 1 being broken away to illustrate a portion of the adjustment means for varying the trajectory of the water stream thrown by the nozzle.

FIG. 1 illustrates a sprinkler nozzle 2 that is part of an irrigation sprinkler. Sprinkler nozzle 2 includes a nozzle body 4 having a nozzle means 5 for throwing a stream of water radially outwardly from nozzle body 4. This invention relates to a sprinkler nozzle 2 in which the trajectory of the water stream, or the flow volume of the water stream, or both, can be quickly and easily adjusted. Preferably, these adjustments can be made from the top of nozzle 2. Various scales or indicia, as described hereafter, will be provided on the top of nozzle 2 to aid the user in making these adjustments.

Nozzle body 4 is carried on the upper end of a riser 8 that forms part of the sprinkler. Preferably, nozzle body 4 is rotatably supported on riser 8 and is driven by a drive means a carried inside riser 8 so as to rotate in a circle about the longitudinal axis of riser 8, namely about a vertical axis. Nozzle body 4 includes a hub 6 having a hexagonal passage 7 for drivingly connecting nozzle body 4 to the output shaft (not shown) of the drive means 9 for transmitting a rotary force or torque from the drive means to nozzle body 6 for rotating nozzle body 4 about the vertical rotational axis. See FIG. 2. This causes the water stream exiting from nozzle 2 to water a circular pattern in the case of a full circle, unidirectional sprinkler or a portion of a circle in the case of a part circle, reversible sprinkler. The Super 600, Super 606 and Super 700 sprinklers manufactured and sold by The Toro Company, the assignee of this invention, are typical examples of irrigation sprinklers having a rotatable nozzle body and riser of this general type.

Riser 8 is also desirably part of a "pop-up" sprinkler in which riser 8 is retractable inside an outer surrounding housing (not shown). This surrounding housing is typically buried in the ground and the top of riser 8 will generally be flush with the top of the surrounding housing and with ground level then riser 8 is retracted. Again, reference can be had to the Super 600, Super 606 and Super 700 sprinklers manufactured and sold by The Toro Company, the assignee of this invention, which all comprise typical examples of "pop-up" irrigation sprinklers.

However, nozzle 2 of this invention is not limited for use with "pop-up" sprinklers. Nozzle body 4 could be carried, if so desired, on a riser 8 that is permanently located above ground.

Figure 2:
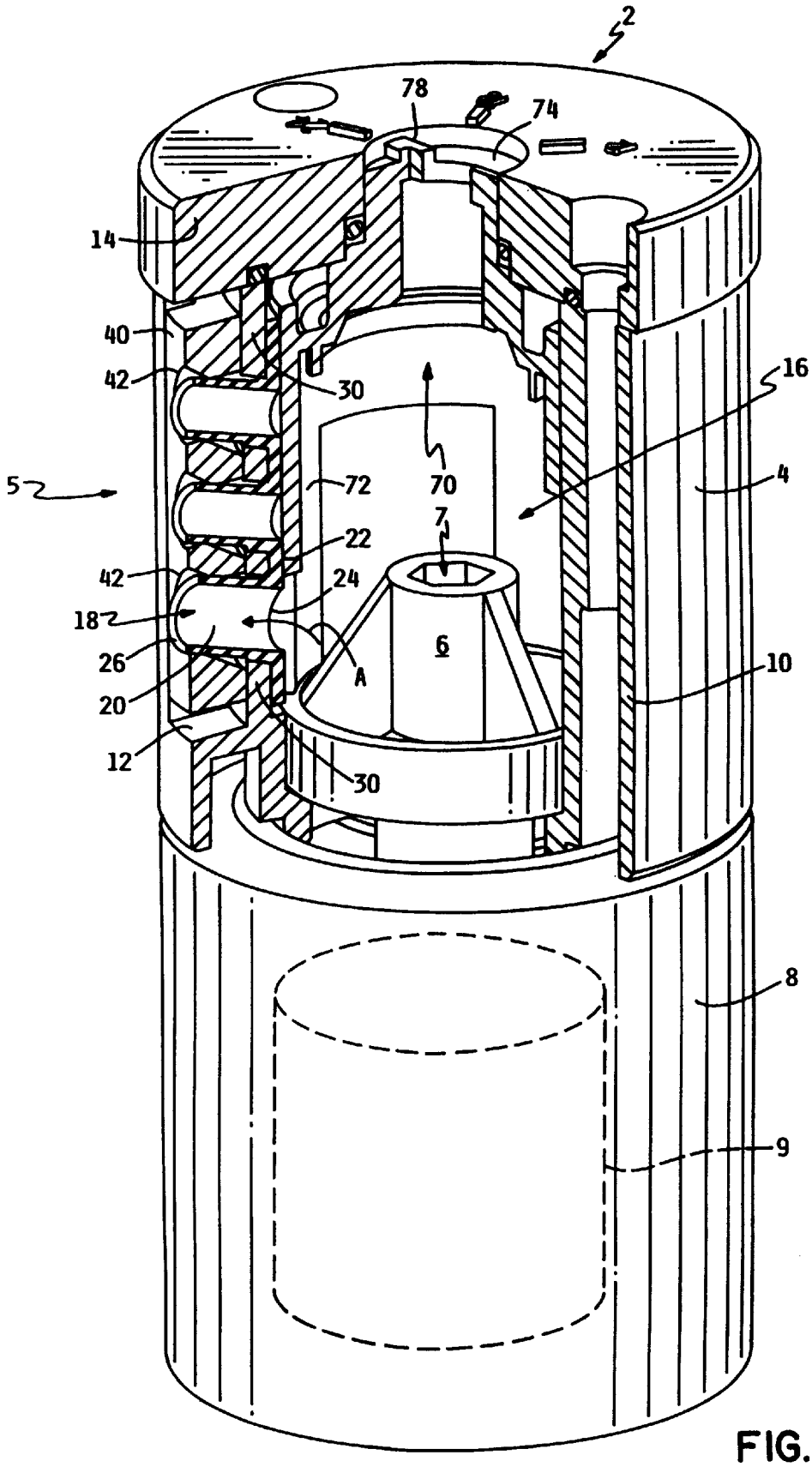
FIG. 2 is a partial cross-sectional view of the sprinkler nozzle of FIG. 1 taken along lines 2—2 in FIG. 1.
Figure 12:
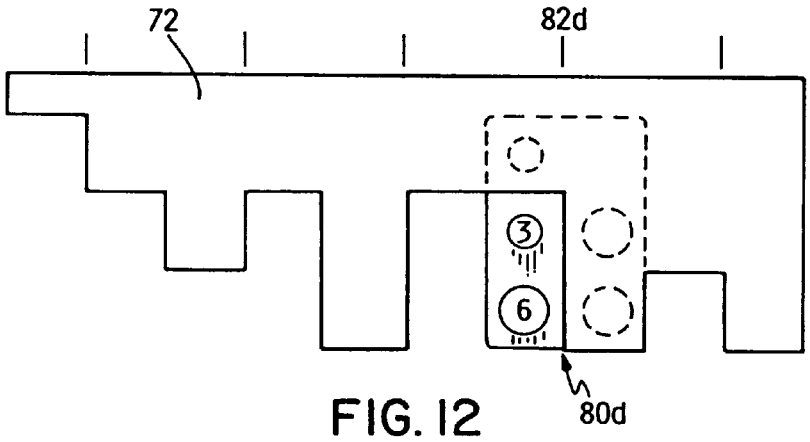
FIGS. 9–13 are diagrammatic operational views showing the different relative positions between the array of nozzle tubes and the adjustment member used to adjust the flow volume of the water stream thrown by the sprinkler nozzle.
Figure 13:
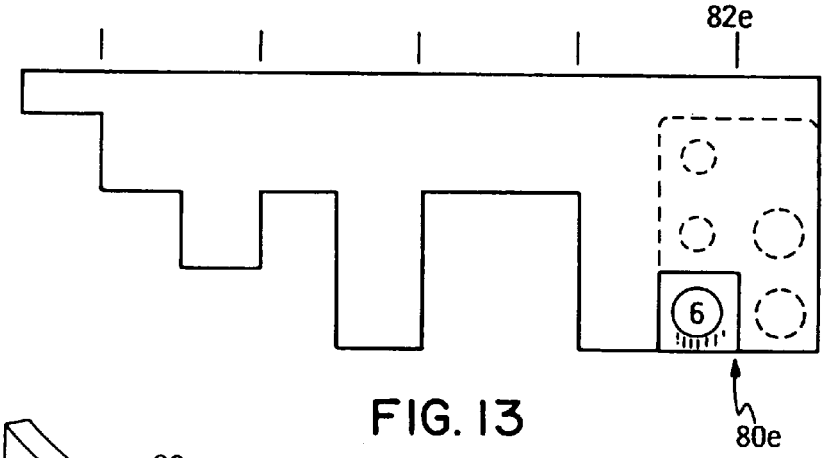

Referring to FIGS. 1 and 2, nozzle body 4 comprises a cylindrical sidewall 10 having a nozzle receiving opening or seat 12 on one side thereof. Seat 12 can have any shape which matches the shape of nozzle means 5 so that nozzle means 5 can be received in seat 12. Since nozzle means 5 of this invention has a generally rectangular shape, seat 12 is also preferably rectangular in shape to allow nozzle means 5 to be placed within seat 12 in a generally recessed fashion. Nozzle body 4 includes a top surface or top wall 14 at its upper end which forms the top -ace of sprinkler nozzle 2. Top wall 14 is both accessible and visible to the user at all times, even when riser 8 is made as part of a "pop-up" sprinkler and is in its retracted condition.

The interior of nozzle body 4 includes a vertical water flow passage 16 that terminates adjacent seat 12. Pressurized water is admitted by a valve (not shown) to the lower end of riser 8 and is then able to flow up into passage 16 through any suitable water connecting passages or ducts. Of course, once water is admitted to the riser 8 and enters passage 16, it is the purpose of nozzle means 5 to allow such water to exit passage 16 in the form of a water stream projected to one side of nozzle body 4.

Figure 7:
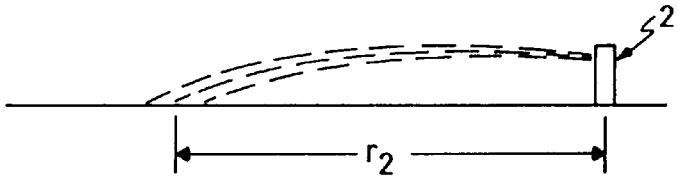
FIG. 7 is a side elevational view of a sprinkler equipped with the sprinkler nozzle of FIG. 1, particularly illustrating the shorter radius of throw achieved when the nozzle tubes are in their second adjusted position of FIG. 6.

Nozzle means 5 of this invention is unique and includes a plurality of individual nozzle ports 18. Each nozzle port 18 throws a separate sub-stream of water that has a smaller flow volume than the flow volume of the stream of water that is capable of being thrown by all of nozzle ports 18 collectively. Nozzle ports 18 are grouped together on one side of nozzle body 4 in a relatively compact array and point in the same direction along a generally common trajectory. Thus, the discrete, individual sub-streams of water that exit through nozzle ports 18 will relatively quickly merge into what appears from a distance to be a single, common water stream projected by nozzle 2. See FIGS. 5 and 7. Nozzle ports 18 can be thought of as throwing a sectionalized water stream with each section of the stream comprising -an individual water sub-stream formed by the flow of water issuing from a particular nozzle port 18.

Figure 3:
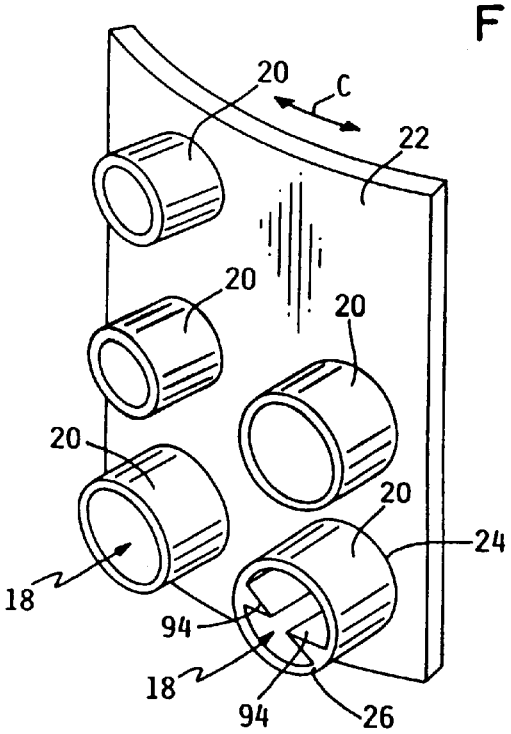
FIG. 3 is a perspective view of one component of the sprinkler nozzle of FIG. 1, particularly illustrating the array of flexible nozzle tubes which comprise the nozzle means for projecting the water stream thrown by the nozzle.

Referring to FIG. 3, nozzle ports 18 are formed by a plurality of flexible nozzle tubes 20 that extend from a common nozzle membrane 22 in a cantilever manner. Preferably, nozzle tubes 20 and membrane 22 are integrally formed or molded as a single piece out of a suitably flexible material such as rubber. Membrane 22 has a generally rectangular shape although other shapes could be used.

Nozzle tubes 20 have an open, radially inner end 24 which is joined to membrane 22 and which extends through membrane 22 to allow water to flow through membrane 22 and into each tube 20. See the flow arrow A in FIG. 2. Each nozzle tube 20 has a short length and terminates in an open, radially outer end 26 which defines one of the nozzle ports 18. Preferably, membrane 22 is molded to have a slight transverse curvature as shown in FIG. 3 by the arrows C. This transverse curvature is shaped to generally conform to the curvature of the cylindrical sidewall 10 of nozzle body 4.

Nozzle tubes 20 are formed on membrane 22 in a rectangular array comprising two vertical rows of spaced apart tubes 20. Referring to FIG. 1, the left row in the array has three tubes 20 and the right row in the array has two tubes 20. However, the number of tubes 20 in the array can obviously be varied from the number shown. In addition, tubes 20 can obviously be placed in compact arrays having other than rectangular shapes, e.g. tubes 20 could be grouped together in a circular or an elliptical array.

A means is provided for supporting the radially inner ends 24 of nozzle tubes 20 in a vertically fixed manner. This support means comprises a base plate 30 that forms the rear end of nozzle seat 12 and which is fixed in nozzle body 4. Base plate 30 has a transverse curvature designed to match the transverse curvature in nozzle membrane 22. Base plate 30 is provided with a plurality of circular openings 32 which match in size and number the number of nozzle tubes 20 provided on membrane 22. Nozzle membrane 22 is supported on base plate 30 simply by pushing nozzle tubes 20 on membrane 22 through openings 32 in base plate 30 with membrane 22 abutting in a face-to-face manner against the back of base plate 30. No leakage will occur, even with this simple press fit between membrane 22 and base plate 30, as the pressure of the water inside nozzle body 4 will seal membrane 22 against the back of base plate 30.

When membrane 22 is installed in base plate 30 in this fashion, the radially inner ends 24 of nozzle tubes 20 are vertically fixed inside nozzle body 4. However, due to the length and flexibility of nozzle tubes 20, the radially outer ends 26 of nozzle tubes 20 are free to flex up and down. Nozzle 2 of this invention takes advantage of this fact and flexes nozzle tubes 20 vertically up and down to change the trajectory of the water stream thrown by nozzle 2. This trajectory adjustment is the first adjustment provided in sprinkler nozzle 2 of this invention.

The means for changing the trajectory of the water stream comprises a trajectory adjustment member 40 that is movably carried on nozzle body 4 and is received in nozzle seat 12 radially outwardly of base plate 30. Trajectory adjustment member 40 comprises a plate-like member having a transverse curve shaped to match that of base plate 30 with adjustment member 40 being abutted against the front of base plate 30 in much the same manner as membrane 22 abuts against the back of base plate 30. In effect, base plate 30 is sandwiched between trajectory adjustment member 40 on one side thereof and nozzle membrane 22 on the other side thereof. See FIGS. 2, 4 and 6.

Trajectory adjustment member 40 includes a plurality of circular holes or openings 42, in size and number equivalent to the size and number of nozzle tubes 20, such that each nozzle tube 20 passes through one hole 42 in adjustment member 40. In fact, holes 42 in adjustment member 40 receive and support nozzle tubes 20 adjacent their radially outer ends 26. Thus, if adjustment member 40 is moved vertically up and down inside nozzle seat 12, the entire array of nozzle tubes 20 will se bent up and down about their radially inner ends 24 by the vertical movement of adjustment member 40 to change she trajectory or the angle of inclination of nozzle tubes 23. In fact, nozzle seat 12 is larger than trajectory adjustment member 40 in a vertical direction to allow for such vertical movement of adjustment member 40.

Figure 8:
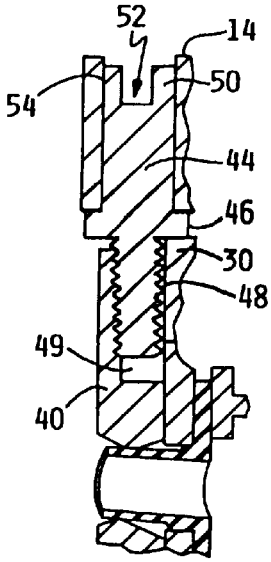
FIG. 8 is a partial cross-sectional view of a portion of the sprinkler nozzle of FIG. 1, particularly illustrating that portion of the trajectory adjustment means comprising the threaded actuating member used to slide the trajectory adjustment member up and down on the nozzle body.

Any means for vertically sliding trajectory adjustment member 40 up and down within nozzle seat 12 and for holding adjustment member 40 in nozzle seat 12 in an adjusted position could be used. However, one simple means comprises a rotatable actuating member 44 that is vertically fixed in nozzle body 4. Referring to FIGS. 1 and 8, actuating member 44 includes a circular head 46 that rests on the top of base plate 30 (or on the top of some other fixed abutment surface in nozzle body 4) to prevent actuating member 44 from itself moving up and down relative to nozzle body 4 when actuating member 44 is rotated. Rotatable actuating member 44 includes a threaded lower end 48 that extends down into and is threaded into an interiorly threaded vertical bore 49 in the top of trajectory adjustment member 40. Thus, if 4 actuating member 44 is rotated about its axis relative to nozzle body 4, the threads on lower end 48 will cause 6 adjustment member 40 to be drawn upwardly inside nozzle seat 12, or pushed downwardly in nozzle seat 12, depending on the direction of rotation of actuating member 44.

The top end 50 of actuating member 44 preferably extends upwardly through nozzle body 4 to be accessible from top wall 14 of nozzle 2. Preferably, top end 50 of actuating member 44 includes a slot 52 for receiving the end of a screwdriver or similar tool to allow sufficient torque to be easily applied to actuating member 44 to rotate actuating member 44. With such a slot 52 provided in top end 50, top end 50 of actuating member 44 can terminate either generally flush with top wall 14 or could even be recessed somewhat beneath top wall 14. An opening 54 in top wall 14 provides access to top end 50 of actuating member 44 to allow a screwdriver or the like to be inserted into slot 52. Thus, actuating member 44 can conveniently be rotated from above sprinkler nozzle 2 without having to remove either top wall 14 or other components of nozzle 2 to gain access to actuating member 44.

Figure 4:
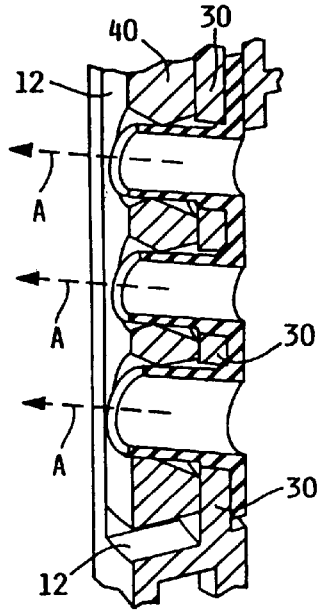
FIG. 4 is a partial cross-sectional view of a portion of the sprinkler nozzle shown in FIG. 1, particularly illustrating a first adjusted position of the nozzle tubes for throwing a water stream having a first predetermined trajectory.

The adjustment of the trajectory of the water stream being thrown by nozzle 2 will be described now in conjunction with FIGS. 4–7. FIG. 4 shows trajectory adjustment member 40 having a first adjusted position in which all of nozzle tubes 20 are oriented at a first predetermined angle relative to the horizontal denoted by the flow arrows A in FIG. 4. In such an adjusted position, the water stream thrown by nozzle 2 reaches a radius that is identified as $r_1$. See FIG. 5 for a graphical depiction of this result.

Figure 5:
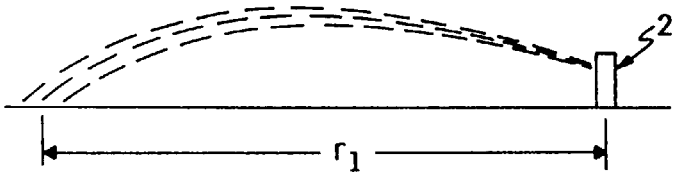
FIG. 5 is a side elevational view of a sprinkler equipped with the sprinkler nozzle of FIG. 1, particularly illustrating the radius of throw achieved when the nozzle tubes are in their first adjusted position of FIG. 4.

The particular radius that is reached depends, at least partially, on the water pressure being supplied to the sprinkler. In other words, with nozzle tubes 20 set at exactly the same angle as that shown in FIG. 4, increasing the water pressure to the sprinkler will generally result in an increased throw radius. Thus, the radius $r_1$ as represented in FIG. 5 is that reached for a particular water pressure when the nozzle tubes are configured as shown in FIG. 4.

Figure 6:
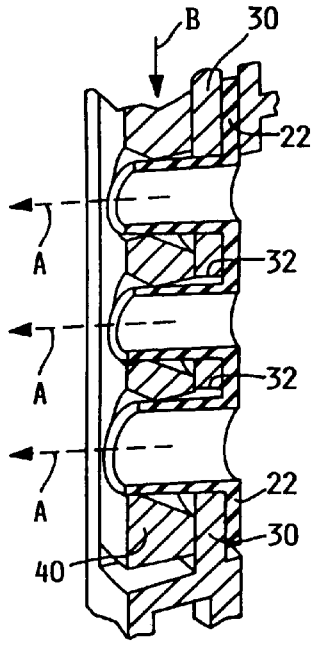
FIG. 6 is a partial cross-sectional view of a portion of the sprinkler nozzle shown in FIG. 1, particularly illustrating a second adjusted position of the nozzle tubes for throwing a water stream having a second predetermined trajectory which is lower than the first trajectory shown in FIG. 4.

Nozzle 2 allows the user to quickly and easily adjust the trajectory of the water stream being thrown by nozzle 2, which in turn adjusts the throw radius of the sprinkler, without having to adjust the water pressure flowing through the sprinkler and without having to turn off the water supply to the sprinkler. For example, if the user wishes to decrease the throw radius of the sprinkler, i.e. to throw the stream closer in to the sprinkler, the user need only rotate actuating member 44 in the direction needed to lower trajectory adjustment member 40 in nozzle seat 12, which can be done even when the sprinkler is operating with water flowing through the sprinkler. This lowering of adjustment member 40 will flex nozzle tubes 20 downwardly relative to their initial orientation until they reach an adjusted orientation in which the angle of inclination of the water sub-streams being thrown by nozzle tubes 20 is decreased. This is illustrated in FIG. 6 with the downward lowering movement of adjustment member 44 represented by the downward arrow B and the flow arrows A representing the sub-streams being depressed relative to their initial orientation as shown in FIG. 4. When nozzle 2 is adjusted as shown in FIG. 6 and assuming the water pressure remains constant, then this lowering of the angle of trajectory will itself shorten the throw radius of the sprinkler causing the sprinkler to throw to a shorter radius, represented as $r_2$ in FIG. 7.

Accordingly, by moving trajectory adjustment member 40 up and down within seat 12 as desired, the user can quickly and easily adjust the trajectory of nozzle tubes 20 to adjust the throw radius of the sprinkler. This can be done from a position above nozzle 2 simply by contacting top end 50 of actuating member 44 and rotating actuating member 44 in the appropriate direction.

To aid the user in determining the proper direction of rotation, a plus (+)/minus (−) scale 56, or similar scale or set of indicia, can be provided on top wall 14 of the sprinkler adjacent to actuating member 44 or to access opening 54. Rotating actuating member 44 in the plus (+) direction will raise adjustment member 40 to increase the trajectory of nozzle tubes 20 and to increase the throw radius. Rotating actuating member 44 in the minus (−) direction will lower adjustment member 40 to decrease the trajectory of nozzle tubes 20 and to decrease the throw radius. Scale 60 is continuously visible to a user who only needs to simply look down on sprinkler nozzle 2 to view top wall 14.

The trajectory adjustment feature just described, which is used primarily to adjust the throw radius of sprinkler nozzle 2, is usable in a sprinkler nozzle whenever this feature is desired. However, sprinkler nozzle 2 of this invention includes a second adjustment that is used to adjust the flow volume of the water stream, namely to adjust the amount or gallonage of water being thrown by the water stream to the desired area. In this regard, openings 32 in base plate 30 and openings 42 in trajectory adjustment member 40 have a fixed size which closely receive nozzle tubes 20 but preferably do not appreciably constrict the diameter of nozzle tubes 32. Thus, such openings 32 and 42 allow water to flow through the diameter of nozzle tubes 32 in an unimpeded, fixed fashion and thus these openings do not themselves function as part of the second adjustment used to adjust the flow volume of water flowing through nozzle means 5.

Both the trajectory and the flow volume adjustments will be shown in this application as incorporated into the same nozzle 2 to provide an extremely versatile and easily adjustable nozzle. For example, if the trajectory of nozzle 2 is drastically shortened to throw a very short radius, then it may be necessary to be able to decrease the amount of water being thrown by nozzle 2 in order to keep the precipitation rate relatively constant and prevent overwatering of the sprinkled area. This is most conveniently done when both adjustments are carried on the same nozzle 2 and are available to the user for selective operation either independently or jointly with one another. However, this invention contemplates that the structure for providing either the trajectory or the flow volume adjustment could be used by itself in a particular sprinkler nozzle without using the structure for providing the other adjustment.

Figure 9:
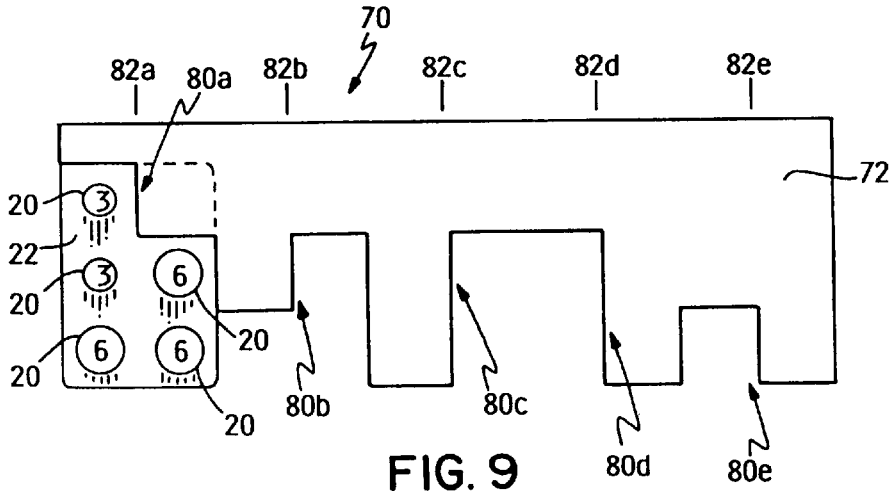

The flow volume adjustment feature is preferably provided by means for selectively changing the number of open nozzle ports 18 by closing off or blocking one or more of the nozzle ports 18 formed by nozzle tubes 20. Preferably, the nozzle tubes 20 are themselves provided in at least two groups with each group having different individual flow capacities. A first group of such tubes is provided having an internal diameter which is sized to throw a first predetermined volume of water per unit of time at a particular pressure, e.g. three gallons per minute. Referring to FIG. 9, nozzle tubes 20 in this first group are indicated by those having the numeral "3" in the interior thereof with this numeral "3" representing a flow volume of 3 gallons per minute. A second group of tubes 20 is provided having a second different flow capacity, e.g. six gallons per minute at the same pressure. Nozzle tubes 20 in this second group are indicated in FIG. 9 by those having the numeral "6" in the interior thereof with this numeral "6" representing a flow volume of 6 gallons per minute. As shown in FIG. 9, there are three 6 gallon nozzle tubes 20 and two 3 gallon nozzle tubes 20 in the nozzle tube array.

If all the nozzle tubes 20 are open so as to be receiving water from flow passage 16 inside nozzle body 4, the total flow volume of the water stream being thrown by nozzle 2 will comprise the sum of the flow volumes of the individual nozzle tubes for a total of 24 gallons in the embodiment of nozzle 2 shown (i.e. 6+6+6+3+3=24). This is the maximum rated flow capacity of sprinkler nozzle 2 at the rated pressure. However, the flow volume actually thrown by nozzle 2 can be easily adjusted to various lower increments simply by closing off or blocking one or more of nozzle ports 18 in various combinations thereof. This is what is done in sprinkler nozzle 2 of this invention using a selectively operable, flow volume adjustment member 70.

Referring to FIG. 2, the flow volume adjustment member 70 includes a cylindrical skirt 72 that is rotatably mounted inside nozzle body 2 immediately behind nozzle membrane 22. This skirt 72 will extend substantially 360° around the interior of the flow passage 16 inside nozzle body 4 and will be arranged to abut against the back of nozzle membrane 22 to selectively close or open various ones of nozzle tubes 20. The upper end of skirt 72 is formed with an upwardly protruding, cylindrical hub 74 that extends up through the center of top wall 14 of nozzle 2.

Hub 74 is received in a recess 76 in top wall 14 and includes protruding wings or flanges 78 to allow the user to put his or her fingers on the top of hub 74 to rotate hub 74 by hand about a vertical axis. When hub 74 is so rotated, skirt 72 is rotated relatively to nozzle membrane 22 and the array of nozzle tubes 20 carried thereon. Preferably, skirt 72 is relatively flexible relative to hub 74 so that the water pressure in flow passage 16 will deform skirt 72 tightly up against the back of membrane 22 to tightly seal skirt 72 against the radially inner ends 24 of nozzle tubes 20.

Skirt 72 is provided with various windows or notched sections 80*a*, 80*b*, 80*c*, 80*d*, etc. along its lower edge that are designed to cooperate with nozzle tubes 20 to open and close various ones of nozzle tubes 20 in various combinations. This will be described in conjunction with FIGS. 9–13 which illustrates skirt 72 of adjustment member 70 in a flat, planar configuration rather than in its usual cylindrical configuration for the sake of clarity. Various detents (not shown) may be provided between adjustment member 70 and nozzle body 4 for holding skirt 72 in various adjusted positions. In any event, for nozzle 2 as shown in this application, there are five adjusted positions of skirt 72. In each of these positions, one of the notched sections 80*a*, 80*b*, 80*c* etc. is aligned with the vertical centerline of the nozzle tube array, with each of these adjusted positions being indicated in FIGS. 9–13 by a line 82*a*, 82*b*, 82*c*, etc. shown above the top edge of skirt 72.

Referring first to FIG. 9, a first adjusted position is shown at the first line 82*a*. In this position, notched section 80*a* is aligned with the nozzle tube array and is so configured to allow all of nozzle tubes 20 to be open. This is the position which allows the maximum flow through nozzle 2 of 24 gallons per minute.

Figure 10:
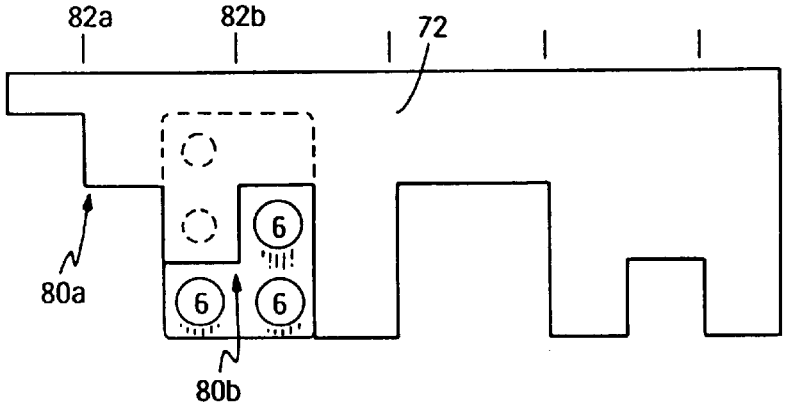
Figure 11:
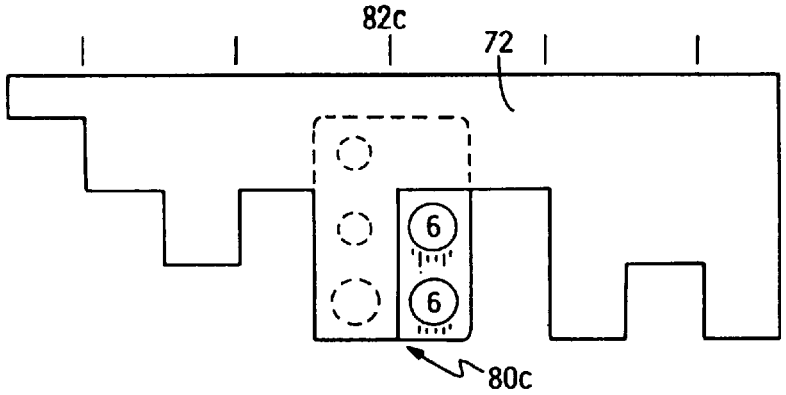

Referring now to FIG. 10. if skirt 72 is rotated to the next position represented by the next line 82*b*, we can see that the notched section 80a is moved out of alignment with the nozzle tube array and the next notched section 80*b* is moved into alignment with the nozzle tube array. This next notched section 80*b* has a different configuration, namely one which allows only the three 6 gallon nozzle tubes in the second group to be open. The two 3 gallon nozzle tubes in the first group are now closed by skirt 72 as the notched section 80*b* is configured to cover them. Thus, the flow now allowed through nozzle 2 in this position of skirt 72 is a total of 18 gallons per minute represented by the flow capacities of those tubes 20 remaining open (i.e. 6+6+6=18). Accordingly, the flow volume has been decreased by 6 gallons per minute simply by rotating the adjustment member from its first position shown in FIG. 9 to its second adjusted position shown in FIG. 10.

Rotation of the adjustment member can be continued around 360° to allow the other notched sections 80 on the lower edge of skirt 72 to be selectively aligned with the nozzle tube array, with each notched section 80 being differently configured to open and close different combinations of nozzle tubes 20. Thus, referring to FIGS. 11–13 sequentially, a third adjusted position 82*c* is provided for throwing 12 gallons per minute (i.e. two 6 gallon tubes are open), a fourth adjusted position 82*d* is provided for throwing 9 gallons per minute (i.e. one 6 and one 3 gallon tube are open), and a fifth adjusted position 82*e* is provided for throwing 6 gallons per minute (i.e. one 6 gallon tube is open).

Preferably, at least some of the notched sections 80 are configured to open nozzle tubes from different groups to allow some flow volumes that are combinations of the different flow volumes of the tubes in the different groups. This is represented in nozzle 2 shown herein by the fourth adjusted position 82*d* shown in FIG. 12 in which one 3 gallon nozzle tube (a tube from the first group) is open along with one 6 gallon nozzle tube (a tube from the second group).

Obviously, the specific flow capacities of the individual nozzle tubes 20, the number of the notched sections 80 in skirt 72, and the configuration of the notched sections 30, as shown herein is by way of illustration only and all of these may obviously be varied. For example, one of the adjusted positions of skirt 72 could be used to close off all nozzle tubes 20 to provide a complete shut off or zero flow condition through nozzle 2. Or, the groups of nozzle tubes could have different flow values. For example, in a nozzle 2 of smaller size, the 6 gallon tubes might be sized to throw only 1 gallon and the 3 gallon tubes might be sized to throw only 0.5 gallons. With half gallon increments in one group, then flow volumes could be obtained in half gallon increments in various combinations by opening various ones of the nozzle tubes in the two different groups of such tubes.

The flow volume adjustment provided in nozzle 2 of this invention is quickly and easily operated from above nozzle 2, i.e. access can be had to hub 74 and wings 78 from top wall 14. In addition, a second scale 90 is provided on top wall 14 to visually indicate to the user the particular flow volume that has been selected. For example, the numbers 24, 18, 12, 9 and 6 are inscribed in top wall 14 surrounding recess 76 with the top of hub 74 being provided with a marker or arrow 92 that points to one of the numbers when adjustment member 70 is in one of its adjusted positions with one of the notched sections 80 aligned with the nozzle tube array. This allows the user to easily read from above nozzle 2 the particular flow volume which has been selected by operation of flow volume adjustment member 70.

Flow volume adjustment member 70 has been shown and described herein as completely opening or closing off various ones of nozzle tubes 20. However, it would be possible for such adjustment member 70 to have the notched sections 80 configured to block or close off just one or more predetermined increments or portions of each nozzle tube, e.g. only one quarter or one half of each nozzle tube is blocked off instead of the entire nozzle tube when the notched section is arranged in a blocking relationship to such tube.

Various modifications will be apparent to those skilled in the art. For example, it is desirable that the water stream being thrown by nozzle 2 be able to water the radially inward portions of the pattern being sprinkled. Accordingly, one or two of nozzle tubes 20 could be set at a fixed angle directed to these portions of the pattern and these tubes would not have their trajectory adjusted along with the rest of tubes 20. Alternatively, flow deflecting ribs or projections could be integrally molded into some of nozzle tubes 20 for deflecting downwardly some of the water being thrown by such tubes. For example, flow guiding ribs 94 are shown in FIG. 3 in one nozzle tube 20 projecting radially inwardly from the inner diameter of such tube. Similar or differently shaped ribs 94 could be used in all or any number of nozzle tubes 20 as may be desired, with ribs 94 being shown only in one particular nozzle tube 20 in FIG. 3 for the purpose of clarity. Thus, this invention is to be limited only by the scope of the appended claims.

I claim:

1. A sprinkler nozzle for throwing at least one water stream having an adjustable trajectory, which comprises:

(a) a nozzle body having an exterior defined by a top wall and a peripheral sidewall extending downwardly from the top wall;

(b) at least one nozzle port, wherein the nozzle port has a radial outer end and a radial inner end to throw a stream of water outwardly from the sidewall of the nozzle body to one side of the nozzle body at a given trajectory relative to a horizontal plane, wherein the nozzle port is adjustable on the nozzle body to allow the trajectory of the water stream issuing from the nozzle port to be adjusted by raising or lowering the radial outer end of the nozzle port relative to the inner end thereof without rotating the nozzle port about a longitudinal fore and aft axis;

(c) a trajectory adjustment member movably carried on the nozzle body for selectively adjusting the trajectory of the nozzle port, wherein the trajectory adjustment member is operatively connected to the nozzle port for raising or lowering the radial outer end of the nozzle port relative to the inner end thereof when the trajectory adjustment member is selectively operated; and (d) wherein the trajectory adjustment member is accessible from the top wall of the nozzle body to be operable from above the sprinkler nozzle.

2. The sprinkler nozzle of claim 1, wherein the trajectory adjustment member comprises an actuating member that is rotatable about an axis that is perpendicular to the top wall of the nozzle body.

3. The sprinkler nozzle of claim 1, wherein the trajectory adjustment member comprises a rotatable actuating member.

4. The sprinkler nozzle of claim 3, wherein the rotatable actuating member has an upper end that is accessible from the top wall of the nozzle body.

5. The sprinkler nozzle of claim 4, wherein the upper end of the rotatable actuating member has an upper surface that is substantially flush with the top wall of the nozzle body.

6. The sprinkler nozzle of claim 4, wherein the rotatable actuating member is operatively connected to the nozzle port at a location beneath the upper end of the actuating member.

7. The sprinkler nozzle of claim 4, wherein the rotatable actuating member has a slot in its upper end for receiving a tool to help turn the actuating member.

8. The sprinkler nozzle of claim 1, wherein the top wall of the nozzle body includes a scale for indicating the directions in which the trajectory adjustment member should be operated in order to raise and lower the trajectory.

9. The sprinkler nozzle of claim 1, wherein the nozzle port is flexible between the inner and outer ends thereof, and wherein the trajectory adjustment member bends the nozzle port up and down to adjust its trajectory.

10. A sprinkler nozzle for a rotary sprinkler having a rotary drive for rotating the nozzle about a rotational axis, the sprinkler nozzle throwing at least one water stream having an adjustable trajectory, which comprises:

(a) a nozzle body having an exterior defined by a top wall and a peripheral sidewall extending downwardly from the top wall;

(b) at least one nozzle port, wherein the nozzle port has a radial outer end and a radial inner end to throw a stream of water outwardly from the sidewall of the nozzle body to one side of the nozzle body at a given trajectory relative to a horizontal plane, wherein the nozzle port is adjustable on the nozzle body to allow the trajectory of the water stream issuing from the nozzle port to be adjusted by raising or lowering the radial outer end of the nozzle port relative to the inner end thereof without rotating the nozzle port about a longitudinal fore and aft axis;

(c) a trajectory adjustment member movably carried on the nozzle body for selectively adjusting the trajectory of the nozzle port, wherein the trajectory adjustment member is operatively connected to the nozzle port for raising or lowering the radial outer end of the nozzle port relative to the inner end thereof when the trajectory adjustment member is selectively operated; and (d) a torgue receiving member on the nozzle body for connecting to the rotary drive to allow the nozzle body to be rotated about its rotational axis.

11. The sprinkler nozzle of claim 10, wherein the trajectory adjustment member is accessible from the exterior of the nozzle body.

12. The sprinkler nozzle of claim 11, wherein the trajectory adjustment member is accessbile from the top wall of the sprinkler body to be operable from above the sprinkler nozzle.

13. A sprinkler nozzle for a rotary sprinkler having a rotary drive for rotating the nozzle about a rotational axis, the sprinkler nozzle throwing at least one water stream having an adjustable trajectory, which comprises:

(a) a nozzle body;

(b) at least one variable trajectory nozzle carried on the nozzle body, wherein the nozzle is adjustable on the nozzle body to allow the trajectory of the water stream issuing from the nozzle to be adjusted without rotating the nozzle about a longitudinal fore and aft axis;

(c) a manually operable, rotatable actuating member carried on the nozzle body which actuating member is configured to be selectively turned by the user by hand, a portion of the actuating member being operatively connected to the nozzle for changing the trajectory of the nozzle when the actuating member is turned by the user; and (d) a torque receiving member on the nozzle body for connecting to the rotary drive to allow the nozzle body to be rotated about its rotational axis.

14. The sprinkler nozzle of claim 13, wherein the rotatable actuating member has one end that is accessible from an exterior wall of the nozzle body.

15. The sprinkler nozzle of claim 14, wherein the rotatable actuating member is operatively connected to the nozzle at a location inwardly from the one end of the actuating member.

16. The sprinkler nozzle of claim 14, wherein the exterior wall of the nozzle body comprises a top wall of the nozzle body.

17. The sprinkler nozzle of claim 14, wherein the rotatable actuating member has a slot in the one end thereof for receiving a tool to help the user turn the actuating member.

18. The sprinkler nozzle of claim 14, wherein the exterior wall of the nozzle body includes a scale for indicating the directions in which the actuating member should be turned in order to raise and lower the nozzle trajectory.

19. The sprinkler nozzle of claim 18, wherein the exterior wall of the nozzle body comprises a top wall of the nozzle body.

20. The sprinkler nozzle of claim 13, wherein the nozzle is flexible, and wherein the actuating member bends the nozzle up and down to adjust its trajectory when the actuating member is turned.

* * * * *